US006360500B1

(12) United States Patent
Wilcox

(10) Patent No.: US 6,360,500 B1
(45) Date of Patent: Mar. 26, 2002

(54) WINDOW SILL COVER

(76) Inventor: Dean E. Wilcox, 535 E. 1910 South, Orem, UT (US) 84058

( * ) Notice: Subject to any disclaimer, the term of this patent is extended or adjusted under 35 U.S.C. 154(b) by 0 days.

(21) Appl. No.: 09/669,066

(22) Filed: Sep. 22, 2000

Related U.S. Application Data

(63) Continuation of application No. 08/767,333, filed on Dec. 16, 1996, now abandoned.

(51) Int. Cl.[7] ..... E06B 1/04

(52) U.S. Cl. ..... 52/217; 52/287.1; 52/211; 52/98; 52/717.01

(58) Field of Search ..... 52/98, 211, 217, 52/287.1, 717.01, 37, 97

(56) References Cited

U.S. PATENT DOCUMENTS

| | | | | |
|---|---|---|---|---|
| 1,954,590 A | | 4/1934 | Hanson | |
| 2,787,034 A | | 4/1957 | Hauck | |
| 3,221,453 A | | 12/1965 | Lietaert | |
| 3,524,291 A | * | 8/1970 | Rozanski | 52/287.1 X |
| 3,552,471 A | | 1/1971 | Hurst et al. | |
| 3,605,356 A | | 9/1971 | Bordner | |
| 3,638,372 A | | 2/1972 | Rosenthal | |
| 3,875,713 A | * | 4/1975 | Laborde | 52/717.01 X |
| 3,977,711 A | | 8/1976 | Lajcak | |
| 4,193,231 A | * | 3/1980 | Molyneux | 52/97 |
| 4,272,931 A | * | 6/1981 | Stanizzo | 52/98 |
| 4,341,048 A | | 7/1982 | Minter | |
| 4,391,072 A | | 7/1983 | Moore | |
| 4,492,062 A | | 1/1985 | Levenez | |
| 4,682,451 A | | 7/1987 | Hubble | |
| 4,810,550 A | | 3/1989 | Gasser | |
| 5,020,756 A | | 6/1991 | Bauer | |
| 5,134,814 A | | 8/1992 | Hauser | |
| 5,222,345 A | | 6/1993 | Riley | |
| 5,336,849 A | * | 8/1994 | Whitney | 52/287.1 X |
| 5,653,072 A | * | 8/1997 | Seelandt-Stasek et al. | 52/217 X |
| 5,836,118 A | * | 11/1998 | Thornton et al. | 52/211 X |

FOREIGN PATENT DOCUMENTS

| | | |
|---|---|---|
| DE | 1 283 480 | 11/1968 |
| DE | 1 900 258 | 9/1969 |
| DE | 26 23 781 | 12/1977 |
| GB | 1 402 621 | 8/1975 |
| GB | 1 433 384 | 4/1976 |
| GB | 2 172 643 A | 9/1986 |

* cited by examiner

*Primary Examiner*—Beth A. Stephan
(74) *Attorney, Agent, or Firm*—Clayton, Howarth, & Cannon, P.C.

(57) ABSTRACT

A window sill cover includes a window sill cover body having a lower wall and an upper wall spaced apart from the upper wall. Preferably, the window sill cover body is a hollow, elongate member having internal support walls positioned between the upper and lower walls. The window sill cover body also preferably includes a convex, elongate terminal portion, which can be hollow and semi-cylindrical. A positioning wall having a retaining edge extends from the lower wall and defines an attachment recess. The retaining edge can be trimmed for positioning of the window sill cover on the window sill. An overhang extends from the lower wall, which can also be trimmed for proper positioning of the window sill cover.

42 Claims, 3 Drawing Sheets

WINDOW SILL COVER

CROSS-REFERENCE TO RELATED APPLICATIONS

This application is a continuation of U.S. patent application Ser. No. 08/767,333, filed Dec. 16, 1996, now abandoned "An Improved Windowstool," which is hereby incorporated herein by reference in its entirety now abandoned.

STATEMENT REGARDING FEDERALLY SPONSORED RESEARCH OR DEVELOPMENT

Not Applicable.

BACKGROUND OF THE INVENTION

1. The Field of the Invention

The present invention relates generally to window sill covers, and more particularly, but not necessarily entirely, to a hollow, extruded window sill cover having a unique fitting means and unique internal support structure.

2. Description of Related Art

With existing building construction technology there is consistently encountered the need to place a cover over the interior aspects of windows of the type incorporating the usual, relatively deep jambs and sills. It is costly to use wooden components, and there is a need for covering window sills with durable, water-resistant materials.

It is known in the prior art, as shown in FIG. 1, to provide a prefabricated window sill cover, designated generally at 10. This window sill cover 10 simply includes a thin, planar panel 12 having a downwardly extending front edge panel 14, the panels 12 and 14 being typically constructed of plastic as a one-piece, unitary member. The window sill cover 10 further includes a base support member 16, typically made from foam. When the window sill cover 10 is properly placed in a building on the interior side of a window frame, the foam base 16 is concealed beneath the L-shaped panels 12, 14, which present an attractive finish.

The prior art window sill cover 10, however, is characterized by several disadvantages. For example, the window sill 10 has very little insulating capacity. Further, the foam base 16 and the plastic shell member 14 have very different coefficients of thermal expansion, such that when they are subjected to repeated temperature changes there results delamination of the plastic panel 12 from the foam base 16.

The prior art is thus characterized by several disadvantages that are addressed by the present invention. The present invention minimizes, and in some aspects eliminates, the above-mentioned failures, and other problems, by utilizing the methods and structural features described herein.

BRIEF SUMMARY AND OBJECTS OF THE INVENTION

It is an object of the present invention to provide a window sill cover that is durable, attractive, inexpensive, easy to manufacture, and easy to use.

It is also an object of the invention to provide a window sill cover made of a unibody construction.

It is another object of the invention to provide a window sill cover that is easily trimmed to fit existing window sills.

It is still another object of the invention to provide a window sill cover that is light in weight.

It is yet another object of the invention to provide a window sill cover that can be manufactured by thermoplastic extrusion.

It is still another object of the invention to provide a window sill cover that has an insulative capability.

The above objects and others not specifically recited are realized in a specific illustrative embodiment of a window sill cover. The window sill cover includes a hollow, elongate window sill cover body configured and adapted to be affixed to a window sill. Internal air spaces are preferably formed in the interior of the window sill cover body. Preferably, the window sill cover body comprises a lower wall, an upper wall spaced apart from the lower wall, and internal support walls disposed within the window sill cover body. In a preferred embodiment of the invention, the upper and lower walls are planar and substantially parallel to each other, and the internal support walls are disposed between the upper and lower walls. In another preferred embodiment of the invention, the internal support walls are substantially orthogonal to the upper wall. In still another preferred embodiment of the invention, the window sill cover body further comprises a convex, elongate proximal terminal portion. In preferred embodiments of the invention this terminal portion is semi-cylindrical and hollow. Moreover, this terminal portion is preferably configured to receive a cap at each lateral end thereof for capping the hollow portion thereof. Preferably, a positioning wall extends downwardly from the lower wall in a non-parallel orientation with respect to the lower wall, and a retaining edge extends from the positioning wall in an at least partially proximal-to-distal direction. The retaining edge preferably further comprises a plurality of interconnected, individual detachable segments to thereby enable the retaining edge to be rendered shorter by detachment of at least one of the detachable segments. The lower wall, positioning wall, and retaining edge define an attachment recess that is preferably rectangular in cross section. In yet another preferred embodiment of the invention, the window sill cover body further comprises a distal side extending upwardly from the lower wall and a distal overhang extends from the distal side in a proximal-to-distal direction, such that the distal side and the distal overhang collectively form a concave space.

In another illustrative aspect of the invention, the window sill cover body is a one-piece, unitary member characterized by an absence of seams or junctions. The one-piece window sill cover body is preferably comprised of a rigid material, such as polyvinyl chloride (PVC).

In still another illustrative aspect of the invention, the window sill cover is characterized by a mass preferably in the range of about 3–9 grams per linear centimeter, more preferably in the range of about 4.5–7.5 grams per linear centimeter, and most preferably in the range of about 5.4–6.6 grams per linear centimeter. Still further, the window sill cover body is preferably characterized by a thickness in the range of about 0.97–1.63 centimeter (⅜–⅝ inch). Further yet, the window sill cover body preferably comprises a surface characterized by a coefficient of friction of less than about 0.5.

A method for covering a window sill comprises:

(a) measuring the window sill to be covered for determining a length measurement;

(b) cutting the window sill cover according to the determined length measurement;

(c) placing the window sill cover on the window sill and trimming the window sill cover body to a width sufficient to cover the width of the window sill; and (d) affixing the window sill cover having the trimmed window sill body to the window sill.

Correct trimming of the window sill cover body can include trimming of the retaining edge, the distal overhang, or both.

Additional objects and advantages of the invention will be set forth in the description which follows, and in part will be apparent from the description, or may be learned by the practice of the invention without undue experimentation. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF THE INVENTION

Figure 1:
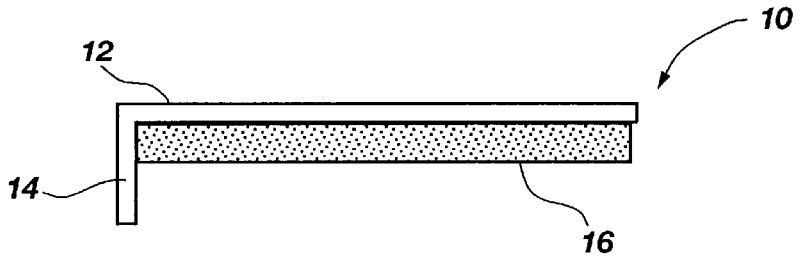
Fig. 1 (PRIOR ART)
FIG. 1 shows a schematic cross sectional view of a window sill cover device as known in the prior art.

For the purposes of promoting an understanding of the principles in accordance with the invention, reference will now be made to the embodiments illustrated in the drawings and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would normally occur to one skilled in the relevant art and having possession of this disclosure, are to be considered within the scope of the invention claimed.

The publications and other reference materials referred to herein to describe the background of the invention and to provide additional detail regarding its practice are hereby incorporated by reference. The references discussed herein are provided solely for their disclosure prior to the filing date of the present application. Nothing herein is to be construed as an admission that the inventors are not entitled to antedate such disclosure by virtue of prior invention.

The term "proximal" shall refer broadly to the concept of a nearest portion. For example, the terminal portion 32 is the proximal-most portion of the window sill cover 10, because it is the nearest portion when said window sill cover 10 is installed.

The term "distal" shall generally refer to the opposite of proximal, and thus to the concept of a further portion, or a furthest portion, depending upon the context.

The phrase "in an at least partially proximal-to-distal direction" shall refer generally to a two-dimensional concept of direction in which the "proximal-to-distal" direction defines one direction or dimension. An item that extends in a non-parallel direction with respect to the "proximal-to-distal" direction, that is, at an angle thereto, thereby involves two components of direction, one of which is in the "proximal-to-distal" direction and the other being in a direction orthogonal to the "proximal-to-distal" direction. The retaining edge 38 extends in a proximal-to-distal direction.

As used herein, "attachment members" means a separate device or structure used to attach prior art window sill covers to the window sill. Such attachment members may be illustrated by part 5 in FIG. 1 of DT2623781, part 6 in FIGS. 1–4 and 6 of DT1283480, the keeper strip 6 and anchor strip 8 in FIG. 6 of GB2172643 and U.S. Pat. No. 4,682,451, and plates 18 including joggle 21 in FIG. 2 of GB1433384. No such attachment member is needed or contemplated for affixing the present window sill cover to the underlying window sill. That is, the window sill cover body of the present invention is configured and adapted to be affixed to a window sill without requiring additional attachment members. "Attachment members" does not include nails, screws, adhesives, and the like, which may be used for affixing the window sill cover to the underlying structure of the window sill.

As used herein, "comprising," "including," "containing," "characterized by," and grammatical equivalents thereof are inclusive or open-ended terms that do not exclude additional, unrecited elements or method steps. "Comprising" is to be interpreted as including the more restrictive terms "consisting of" and "consisting essentially of."

As used herein, "consisting of" and grammatical equivalents thereof exclude any element, step, or ingredient not specified in the claim.

As used herein, "consisting essentially of" and grammatical equivalents thereof limit the scope of a claim to the specified materials or steps and those that do not materially affect the basic and novel characteristic or characteristics of the claimed invention.

Figure 2:
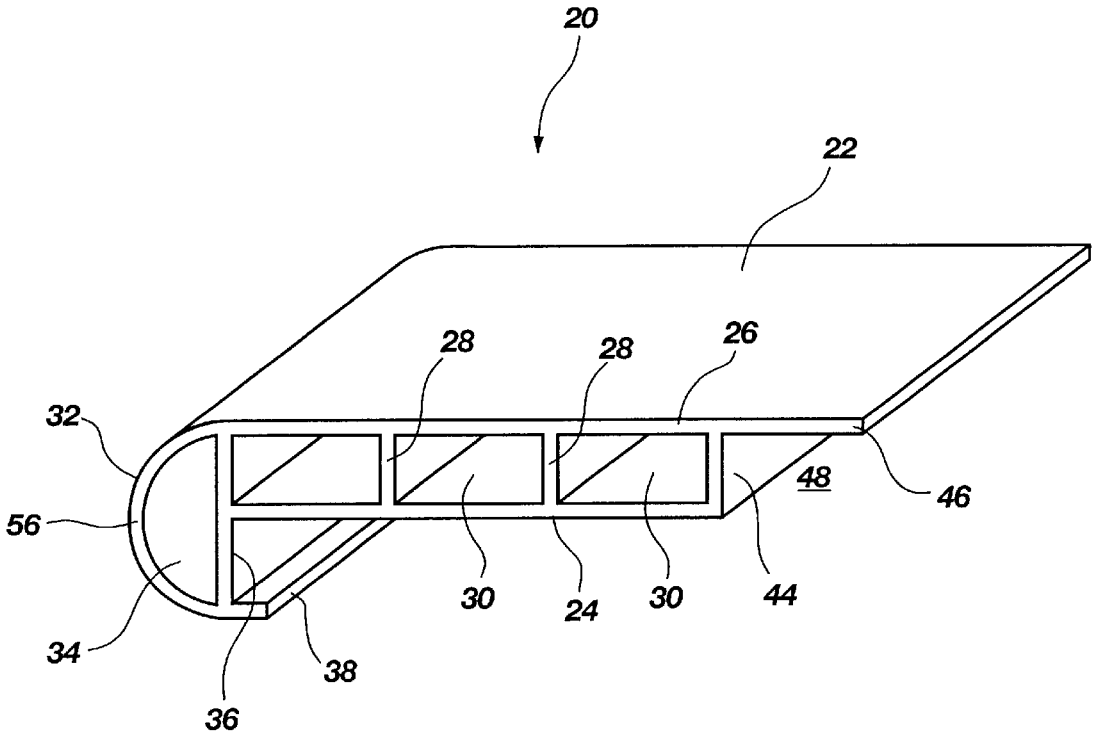
FIG. 2 shows a perspective view of an illustrative window sill cover according to the present invention.

Referring now to FIG. 2, there is shown an illustrative window sill cover 20 according to the present invention. The perspective and cross sectional views of the window sill cover 20 shown in FIGS. 1 and 2 reveal a window sill cover body 22 comprising a lower wall 24 and an upper wall 26 spaced apart from the lower wall 24. Within the window sill cover body 22 there is a plurality of interior support walls 28 spaced apart from each other. These interior support walls 28 are preferably disposed between the upper wall 26 and the lower wall 24. In the illustrative embodiment shown in FIGS. 1 and 2, these interior support walls 28 are disposed substantially orthogonal to the upper wall 26, although such an orthogonal disposition is not critical. This arrangement of the lower wall 24, upper wall 26, and interior support walls 28 defines a plurality of internal air spaces 30 within the window sill cover body 22. These air spaces 30 are preferably closed off from the atmosphere and help to provide an insulative capability to the window sill cover.

Figure 3:
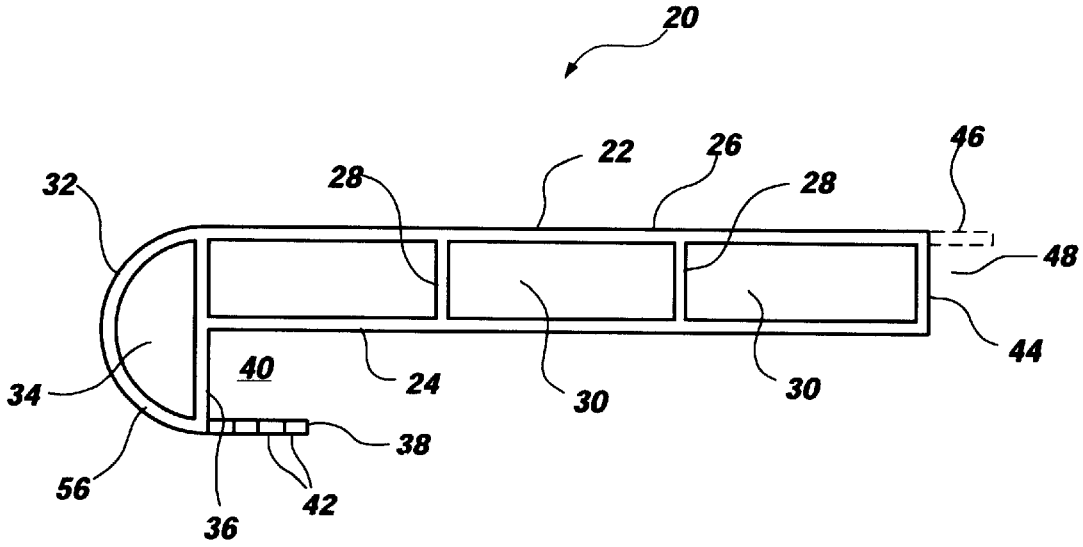
FIG. 3 shows a schematic cross section view of the illustrative window sill cover of FIG. 2 according to the present invention.
Figure 4A:
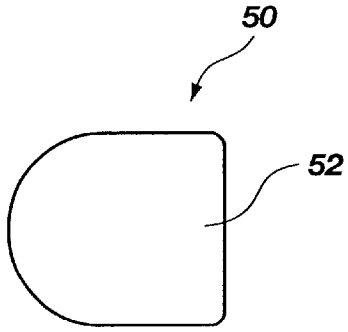
FIGS. 4A–E show, respectively, top, side, bottom, distal end, and proximal end views of a cap configured for use in connection with the illustrative window sill cover of FIG. 2 according to the present invention.
Figure 4D:
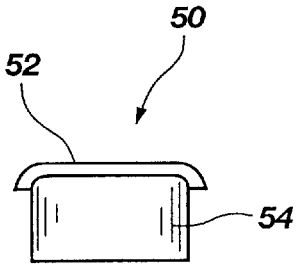
Figure 4B:
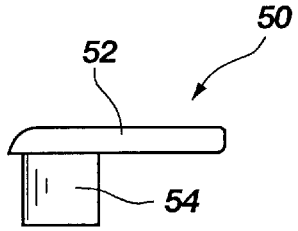
Figure 4E:
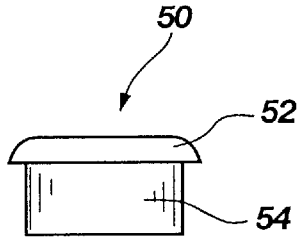
Figure 4C:
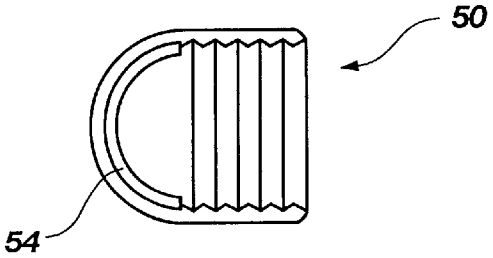

Still referring to FIGS. 1 and 2, the illustrative window sill cover body 22 further comprises a convex, elongate, proximal terminal portion 32. In a preferred embodiment of the invention, the terminal portion 32 is preferably partially-cylindrical in shape, more preferably semi-cylindrical in shape. Moreover, the terminal portion is preferably hollow, defining an air space 34. In another aspect of the window sill cover 10, a positioning wall 36 extends downwardly from the lower wall 24 in a non-parallel orientation with respect to the lower wall 24. Still further, a retaining edge 38 extends from the positioning wall 36 in an at least partially proximal-to-distal direction. The lower wall 24, positioning wall 36, and retaining edge 38 collectively form an attachment recess 40 (best seen in FIG. 3), which is preferably rectangular in cross section. In a still further aspect of the invention, the retaining edge 38 preferably comprises a plurality of interconnected, individual detachable segments 42 (FIG. 3). This configuration enables the retaining edge 38 to be trimmed to a selected dimension by detaching one or more of the detachable segments 42.

The window sill cover 10 further comprises a distal side 44 extending upwardly from the lower wall 24. A distal overhang 46 (shown in phantom in FIG. 2) preferably extends from the distal side 44 in a proximal-to-distal direction such that the distal side 44 and the distal overhang 46 collectively form a concave space 48. Preferably, this concave space 48 is also rectangular in cross section, and the concave space 48 is positioned in a parallel orientation with respect to the attachment recess 40.

FIGS. 4A–E show various views of an illustrative cap 50 basically comprising a generally planar outer member 52 and an arcuate inner member 54 disposed thereon. This inner member 54 is configured to be inserted into the lateral end 56 of the air space 34 in the terminal portion 32 of the window sill cover body for capping the air space 34. Similarly, the air space 34 is configured to receive the inner member 54 of the cap 50. Therefore, the shape of the inner member 54 preferably corresponds to the shape of the proximal side of the air space 34. The outer member 52, preferably has a pleasing appearance that enhances the overall appearance of the window sill cover 20.

It will be apparent to any person skilled in the art that the present window sill cover is formed by a unibody construction. That is, there are no layers of materials having differing coefficients of thermal expansion. Thus, there is no delamination upon repeated cycles of heating and cooling. Moreover, this unibody construction permits ease of manufacturing, preferably by thermoplastic extrusion techniques well known in the art. Preferred materials for construction of the window sill cover are rigid plastic materials, such as PVC (polyvinyl choride), and the like. Further, the material used for manufacture of the window sill cover will preferably yield a coefficient of friction less than about 0.5 at the surface of the window sill cover. A window sill cover constructed in this manner is durable, inexpensive, and attractive. Further, the window sill cover can be manufactured in various colors, which provides purchasers of these window sill covers with a selection for matching colors in the interior of the building.

It will be further recognized that a window sill cover according to the present invention is lighter in weight than prior art window sill covers. In a preferred embodiment of the invention, the mass per unit length of the window sill cover is about 3–9 grams per linear centimeter, more preferably is about 4.5–7.5 grams per linear centimeter, and most preferably is about 5.4–6.6 grams per linear centimeter. The depth of the window sill cover body is limited only by functionality, but in a preferred embodiment will be in the range of about 0.97–1.63 cm (⅜–⅝ inch), and more preferably about 1.3 cm (½ inch).

The window sill cover is used by measuring the length of the sill to be covered and then cutting a piece of the window sill cover to the appropriate length. The piece of window sill cover is then placed over the window sill, with the lower wall resting on the top of the sill and the retaining edge adjacent to the interior wall below the window sill. The retaining edge and the distal overhang can be trimmed to fit the width of the sill.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An interior window sill cover comprising:

a hollow, elongate window sill cover body configured and adapted to be affixed to a window sill;

internal support walls disposed within said window sill cover body;

wherein said window sill cover body comprises an elongate main body having a proximal end, and a convex, elongate, proximal terminal portion disposed on the proximal end of the main body;

wherein said terminal portion includes a rear portion that is wider than a width of the proximal end of the main body, and a rear wall;

wherein the terminal portion further includes a front wall that is partially-cylindrical in shape, said front wall having a width that is wider than a width of the proximal end of the main body, and wherein at least a portion of the rear wall of said terminal portion extends downwardly from the proximal end of the main body to thereby form an exposed positioning wall residing beneath the main body for use in positioning the window sill cover body against an edge.

2. The interior window sill cover of claim 1 wherein the window sill cover body further comprises a lower wall and an upper wall spaced apart from said lower wall.

3. The interior window sill cover of claim 2 wherein the lower wall is a substantially planar member, and wherein the upper wall is a substantially planar member.

4. The interior window sill cover of claim 3 wherein the lower wall and the upper wall are disposed in a substantially parallel orientation with respect to each other.

5. The interior window sill cover of claim 2 wherein the internal support walls are disposed between the lower wall and the upper wall.

6. The interior window sill cover of claim 5 wherein the internal support walls are disposed in a substantially orthogonal orientation with respect to the upper wall.

7. The interior window sill cover of claim 2 further comprising a positioning wall extending downwardly from said lower wall in a non-parallel orientation with respect to said lower wall, and a retaining edge extending from said positioning wall in an at least partially proximal-to-distal direction.

8. The interior window sill cover of claim 2 further comprising a distal side extending upwardly from the lower wall.

9. The interior window sill cover of claim 8 further comprising a distal overhang extending from the distal side in a proximal-to-distal direction, such that said distal side and said distal overhang collectively form a concave space.

10. The interior window sill cover of claim 1 wherein said window sill cover body comprises a convex, elongate, proximal terminal portion.

11. The interior window sill cover of claim 10 wherein the terminal portion is partially-cylindrical in shape.

12. The interior window sill cover of claim 11 wherein the terminal portion is hollow.

13. The interior window sill cover of claim 1, wherein the window sill cover body comprises a hollow, proximal terminal portion, and wherein said terminal portion comprises two lateral ends, each of which is configured for receiving a cap for closing said hollow terminal portion.

14. The interior window sill cover of claim 13 further comprising a cap disposed on each of said lateral ends, said cap comprising a generally planar outer member and an inner member disposed thereon for being received in the hollow terminal portion.

15. The interior window sill cover of claim 1 wherein the window sill cover body includes a rectangular attachment recess formed thereon.

16. An interior window sill cover comprising:

a hollow, elongate window sill cover body configured and adapted to be affixed to a window sill; and internal support walls disposed within said window sill cover body;

wherein the retaining edge further comprises a plurality of interconnected, individual detachable segments to thereby enable said retaining edge to be rendered shorter by detachment of at least one of said detachable segments;

wherein the window sill cover body further comprises a lower wall and an upper wall spaced apart from said lower wall;

further comprising a positioning wall extending downwardly from said lower wall in a non-parallel orientation with respect to said lower wall, and a retaining edge extending from said positioning wall in an at least partially proximal-to-distal direction.

17. An interior window sill cover comprising:

a hollow, elongate window sill cover body configured and adapted to be affixed to a window sill;

wherein said window sill cover body includes a rectangular attachment recess formed thereon;

wherein said window sill cover body comprises (i) an elongate main body having a lower surfaces (ii) a terminal portion having a front wall that is partially-cylindrical in shape and a rear wall extending downwardly from the main body, and a retaining edge formed on said rear wall, and (iii) at least three internal air spaces formed in the main body;

wherein the rectangular attachment recess is formed in part by the lower surface of the elongate main body and by the retaining edge.

18. The interior window sill cover of claim 17 wherein the window sill cover body further comprises a lower wall and an upper wall spaced apart from said lower wall.

19. The interior window sill cover of claim 18 further comprising a positioning wall extending downwardly from said lower wall in a non-parallel orientation with respect to said lower wall, and a retaining edge extending from said positioning wall in an at least partially proximal-to-distal direction.

20. The interior window sill cover of claim 18 further comprising a distal side extending upwardly from the lower wall.

21. The interior window sill cover of claim 19 wherein the lower wall is a substantially planar member, and wherein the upper wall is a substantially planar member.

22. The interior window sill cover of claim 21 wherein the lower wall and the upper wall are disposed in a substantially parallel orientation with respect to each other.

23. The interior window sill cover of claim 22 wherein the window sill cover body further comprises internal support walls disposed within said window sill cover body.

24. The interior window sill cover of claim 23 wherein the internal support walls are disposed between the lower wall and the upper wall.

25. The interior window sill cover of claim 24 wherein the internal support walls are disposed in a substantially orthogonal orientation with respect to the upper wall.

26. The interior window sill cover of claim 20 further comprising a distal overhang extending from the distal side in a proximal-to-distal direction, such that said distal side and said distal overhang collectively form a concave space.

27. The interior window sill cover of claim 17 wherein the window sill cover body further comprises a convex, elongate, proximal terminal portion.

28. The interior window sill cover of claim 27 wherein the terminal portion is partially-cylindrical in shape.

29. The interior window sill cover of claim 27 wherein the terminal portion is hollow.

30. An interior window sill cover comprising:

a hollow, elongate window sill cover body configured and adapted to be affixed to a window sill;

wherein said window sill cover body includes a rectangular attachment recess formed thereon;

wherein the window sill cover body further comprises a lower wall and an upper wall spaced apart from said lower wall;

wherein the retaining edge further comprises a plurality of interconnected, individual detachable segments to thereby enable said retaining edge to be rendered shorter by detachment of at least one of said detachable segments;

further comprising a positioning wall extending downwardly from said lower wall in a non-parallel orientation with respect to said lower wall, and a retaining edge extending from said positioning wall in an at least partially proximal-to-distal direction.

31. A window sill cover characterized by an absence of foam material, comprising:

a hollow, elongate window sill cover body configured and adapted to be affixed to a window sill, said window sill cover body comprising a substantially planar lower wall and a substantially planar upper wall spaced apart from said lower wall wherein the lower wall and the upper wall are disposed in a substantially parallel orientation with respect to each other;

internal support walls disposed within said window sill cover body and between the lower wall and the upper wall such that the internal support walls are disposed in a substantially orthogonal orientation with respect to the upper wall;

a positioning wall extending downwardly from said lower wall in a non-parallel orientation with respect to said lower wall, and a retaining edge extending from said positioning wall in an at least partially proximal-to-distal direction wherein the retaining edge comprises a plurality of interconnected, individual detachable segments to thereby enable said retaining edge to be rendered shorter by detachment of at least one of said detachable segments, wherein said positioning wall, retaining edge, and lower wall collectively form a rectangular attachment recess;

a distal side extending upwardly from the lower wall;

a distal overhang extending from the distal side in a proximal-to-distal direction, such that said distal side and said distal overhang collectively form a concave space, which is rectangular in cross section;

wherein the window sill cover body further comprises a convex, elongate, proximal terminal portion having lateral ends, wherein the terminal portion is hollow and partially-cylindrical in shape, and the lateral ends are each configured for receiving a cap comprising an arcuate inner member disposed on a generally planar outer member;

wherein said window sill cover body is a one-piece, unitary member comprised of a rigid material comprising polyvinyl chloride and characterized by an absence of seams or junctions or separate interconnecting members; and wherein said window sill cover body is characterized by a mass in the range of about 3–9 grams per linear centimeter, a majority of said window sill cover body is characterized by a thickness in the range of about 0.97–1.63 centimeters, and wherein said window sill cover body comprises a surface characterized by a coefficient of friction of less than about 0.5.

32. A window sill cover comprising:

a hollow, elongate window sill cover body configured and adapted to be affixed to a window sill;

wherein said window sill cover body further comprises a convex, elongate, proximal terminal portion;

wherein said window sill cover body further comprises a plurality of internal support walls disposed within said window sill cover body;

wherein the window sill cover body further comprises a lower wall and an upper wall spaced apart from said lower wall;

further comprising a positioning wall extending downwardly from said lower wall in a non-parallel orientation with respect to said lower wall, and a retaining edge extending from said positioning wall in an at least partially proximal-to-distal direction;

wherein the retaining edge further comprises a plurality of interconnected, individual detachable segments to thereby enable said retaining edge to be rendered shorter by detachment of at least one of said detachable segments.

33. The window sill cover of claim 32 wherein the terminal portion is partially-cylindrical in shape.

34. The window sill cover of claim 32 wherein the terminal portion is hollow.

35. The window sill cover of claim 32 wherein the window sill cover body includes a rectangular attachment recess formed thereon.

36. The window sill cover of claim 32 wherein the lower wall is a substantially planar member, and wherein the upper wall is a substantially planar member.

37. The window sill cover of claim 36 wherein the lower wall and the upper wall are disposed in a substantially parallel orientation with respect to each other.

38. The window sill cover of claim 32 wherein the internal support walls are disposed between the lower wall and the upper wall.

39. The window sill cover of claim 38 wherein the internal support walls are disposed in a substantially orthogonal orientation with respect to the upper wall.

40. The window sill cover of claim 32 further comprising a distal side extending upwardly from the lower wall.

41. The window sill cover of claim 40 further comprising a distal overhang extending from the distal side in a proximal-to-distal direction, such that said distal side and said distal overhang collectively form a concave space.

42. The window sill cover of claim 32 wherein the window sill cover body includes a rectangular attachment recess formed thereon.

* * * * *